US009099775B2

(12) United States Patent
Dussopt et al.

(10) Patent No.: US 9,099,775 B2
(45) Date of Patent: Aug. 4, 2015

(54) RADIATING CELL HAVING TWO PHASE STATES FOR A TRANSMITTING NETWORK

(75) Inventors: Laurent Dussopt, Grenoble (FR); Antonio Clemente, Seyssins (FR)

(73) Assignee: COMMISSARIAT A L'ENERGIES ALTERNATIVES, Paris (FR)

( * ) Notice: Subject to any disclaimer, the term of this patent is extended or adjusted under 35 U.S.C. 154(b) by 192 days.

(21) Appl. No.: 13/995,877

(22) PCT Filed: Dec. 21, 2011

(86) PCT No.: PCT/EP2011/073565

§ 371 (c)(1),
(2), (4) Date: Jun. 25, 2013

(87) PCT Pub. No.: WO2012/085067

PCT Pub. Date: Jun. 28, 2012

(65) Prior Publication Data

US 2013/0271346 A1 Oct. 17, 2013

(30) Foreign Application Priority Data

Dec. 24, 2010 (FR) ..... 10 61253

(51) Int. Cl.

| | |
|---|---|
| ***H01Q 1/38*** | (2006.01) |
| ***H01Q 3/24*** | (2006.01) |
| ***H01Q 3/46*** | (2006.01) |
| ***H01Q 21/00*** | (2006.01) |

(52) U.S. Cl.

CPC ..... *H01Q 3/247* (2013.01); *H01Q 3/46* (2013.01); *H01Q 21/0018* (2013.01)

(58) Field of Classification Search

CPC ..... H01Q 21/0018; H01Q 3/247
USPC ..... 343/700 MS, 725, 729, 853, 876, 893
See application file for complete search history.

(56) References Cited

U.S. PATENT DOCUMENTS 4,053,895 A 10/1977 Malagisi
4,367,474 A * 1/1983 Schaubert et al. ..... 343/700 MS (Continued)

FOREIGN PATENT DOCUMENTS

| | | | |
|---|---|---|---|
| DE | 3150235 | A1 | 6/1983 |
| EP | 0646983 | A2 | 4/1995 |
| WO | 2009/023551 | A1 | 2/2009 |

OTHER PUBLICATIONS

H. Kaouach, et al., "Design and Demonstration of 1-bit and 2-bit Transmit-Arrays at X-Band Frequencies", Proceedings of the 39th European Microwave Conference, Sep. 29, 2009, pp. 918-921, IEEE, Piscataway, NJ, USA, XP031551470.
King-Wai Lam, et al., "Implementation of Transmitarray Antenna Concept by using Aperture-Coupled Microstrip Patches", Proceedings of 1997 Asia Pacific Microwave Conference, Jan. 1, 1997, pp. 433-436, vol. 1, XP055006170.
Colan G.M. Ryan, et al., "A Wideband Transmitarry Using Dual-Resonant Double Square Rings", IEEE Transaction on Antennas and Propagation, May 1, 2010, vol. 58, No. 5, IEEE Service Center, Piscataway, NJ, USA, XP011303863.
Alfonso Munoz-Acevedo, et al., "Ku Band Active Transmitarray Based on Microwave Phase Shifters", European Conference on Antennas and Propagation, 2009, five pages.
Jonathan Y. Lau, et al, "A Low-Cost Reconfigurable Transmitarray Element", IEEE AP-S International Symposium, 2009, four pages.

*Primary Examiner* — Tho G Phan
(74) *Attorney, Agent, or Firm* — Baker & Hostetler LLP

(57) ABSTRACT

A radiating cell having two phase states suitable for a transmitter array able to transmit microwave frequency signals, the cell comprising a first antenna and a second antenna arranged on either side of an assembly comprising two substrate layers separated by a ground plane, the second antenna comprising a conducting element able to radiate, the cell comprising comprises at least two switching means, said means each comprising an on state and an off state between two ports, one of said ports being connected to the second radiating element, said switching means being controlled in opposition. The radiating cell applies notably to the implementation of transmitter arrays employing several configurable cells to control the radiation pattern.

16 Claims, 6 Drawing Sheets

(56) References Cited

U.S. PATENT DOCUMENTS 4,379,296 A * 4/1983 Farrar et al. ..... 343/700 MS
4,521,781 A * 6/1985 Campi et al. ..... 343/700 MS
5,835,062 A * 11/1998 Heckaman et al. .... 343/700 MS
6,195,047 B1 * 2/2001 Richards ..... 343/700 MS
6,417,807 B1 * 7/2002 Hsu et al. ..... 343/700 MS
6,930,639 B2 * 8/2005 Bauregger et al. ..... 343/700 MS

* cited by examiner

RADIATING CELL HAVING TWO PHASE STATES FOR A TRANSMITTING NETWORK

CROSS-REFERENCE TO RELATED APPLICATIONS

This application is a National Stage of International patent application PCT/EP2011/073565, filed on Dec. 21, 2011, which claims priority to foreign French patent application No. FR 1061253, filed on Dec. 24, 2010, the disclosures of which are incorporated by reference in their entirety.

FIELD OF THE INVENTION

The present invention relates to a radiating cell having two phase states and able to implement an array antenna or a lens antenna. It applies notably to the implementation of transmitter arrays employing several configurable cells to control the radiation pattern of the antenna.

BACKGROUND

Transmitter array antennas, sometimes designated by the term "transmit-array antenna", are commonly used in the 1-100 GHz frequency domain for focusing a radiation; for this reason, they are therefore often also called discrete-lens antennas.

Array antennas of such a type comprise a large number of individual radiating cells able to receive an electromagnetic field on one face and to transmit it on the opposite face with minimum attenuation and a known phase shift. Antennas of this type are generally known for forming a wave projector, transforming at their output the properties of the wave entering at their input.

As illustrated in FIG. 1, an example of an array antenna is given which comprises a reception surface 111 which is generally illuminated by one or more primary sources 101, the other surface 112, also called the transmission surface, constituting the radiating aperture of the antenna.

The two surfaces 111 and 112 are generally separated by a phase shift device 113 so as to allow the modification of the phase and of the direction of the radiation emitted by the primary source or sources.

The antennal array operates in an identical manner in transmission or reception as long as the array does not contain any non-reciprocal element such as an amplifier or certain magnetic components. In the converse case, the antennal array is designed to operate exclusively either in transmission, or in reception.

The widely prevalent transmitter arrays used in military applications and/or general-public communication systems, comprise multiple advantages, notably:

- energy efficiency at high microwave frequencies (of the order of several GHz and beyond) by virtue of the transmission by radiation in the air between the primary source and the phase shift cells;
- simplicity and cost of implementation for arrays comprising a large number of elements (several hundred and beyond) corresponding to very directional antennas;
- reduced bulk, mass, and cost of implementation by virtue of the fact that these arrays are implemented in planar technology, generally on printed circuit;
- a radiation pattern provided with good polarization purity by virtue of the array structure based on elementary antennas whose imperfections can mutually compensate one another and make it possible to generate a beam with very pure linear or circular polarization;

- good quality of the radiation pattern at the level of the shape of the beam and of the sidelobes by virtue of the position of the primary source situated in the opposite direction to the direction of the principal beam generated by the array.

To extend the possibilities offered by these transmitter arrays, efficient and uncomplicated systems have been designed in compact form, though their output beam (or the phase/direction of radiation) is fixed. However, research has been conducted to make it possible to have systems for which it is possible to control the phase shift in transmission in an electronic manner in order to control the radiation pattern of the antenna and thus off-set the beam and/or modify its shape. Several techniques have been proposed for these purposes.

For example, a reconfigurable (nonsymmetric) cell using radiating slots as antennas, perpendicular to one another and situated on either side of an assemblage of two substrates, has been proposed in the international patent application referenced under the publication number WO2009023551.

Resonators in segments arranged between the two slots make it possible to ensure electromagnetic coupling between these two slots, and breakers placed at various points of these resonators make it possible to select a mode of coupling from four possible modes, each mode corresponding to transmission phases differing from one another by 90°.

The resonators of this structure form a filter, each segment of these resonators forms a resonating circuit coupled to a slot antenna. By actuating the breakers, the resonant frequency of the complete structure is modified.

This cell therefore makes it possible to generate four phase states with low transmission losses.

However, a drawback of this cell is its narrow passband (of the order of a few percent), which is a direct consequence of the use of the coupling technique, which relies on resonators necessarily having a frequency dispersion of significant phase.

Another technique, in the form of a transmitter array completely separating the two antennas and the phase shift circuit has been proposed in A. Munoz-Acevedo, P. Padilla, M. Sierra-Castaner, "Ku band Active transmitarray based on microwave phase shifters," European Conference on Antennas and Propagation, 2009. This approach makes it possible to use a phase shift circuit covering the whole of the possible 360° phase range.

However, the implementation of such a transmitter array is complicated since it requires non-integrated phase shifters, which are therefore of large dimensions, connected perpendicularly to the plane of the antennas.

Also, a reconfigurable cell comprising two patch antennas separated by a ground plane and coupled by a slot, termed the coupling slot, made in the ground plane, is known from J. Y. Lau, S. V. Hum, "A low-cost reconfigurable transmitarray element," IEEE AP-S Int. Symp., 2009. Each patch antenna is separated into two parts by a median slot. Variable-capacitance diodes are placed on these slots as well as on the coupling slot. By controlling the bias voltage of these diodes, the resonant frequency of the patches and of the coupling slot varies as does the transmission phase over a range of as much as 360°.

The principal advantage of this solution is to allow a continuous variation of the transmission phase over a significant range of close to 360°.

However, the experimental results have revealed several drawbacks:

- a significant level of loss of the order of 3 dB and varying in an appreciable manner as a function of the transmission phase;

a narrow passband due to the use of resonators;

a high number of components and complicated means of control of the components, the control lines having to be connected to the radiating elements, so giving rise, moreover, to appreciable perturbations.

SUMMARY OF THE INVENTION

An aim of the invention is to propose a radiating cell with wide passband defined at −3 dB of transmission with respect to the nominal frequency of the cell, for example of the order of 15% or 20%, and which can be integrated into a transmitter array whose radiation pattern is configurable.

For this purpose, the subject of the invention is a radiating cell for forming an antenna integratable into an array and able to transmit microwave frequency signals, the cell comprising a first radiating element and a second radiating element arranged on either side of a ground plane, the second radiating element comprising at least one conducting surface able to radiate, characterized in that it comprises at least a first and a second switching means, said means each comprising an on state and an off state between two ports, one of said ports being connected to the second radiating element, said switching means being controlled in opposition so that when said first switching means is in the on state, said second means is in the off state, these first and second switching means furthermore being controlled so that the current flowing in the conducting surface is in phase opposition depending on whether the first switching means is in the on state or whether the second switching means is in the on state.

According to a variant of the invention, the second radiating element comprises first and second disjoint surfaces electrically isolated from one another.

According to a variant of the invention, said first and second surfaces form a planar antenna, said first surface being linked to the first radiating element, said second surface comprising peripheral conducting zones of the second radiating element, the switching means being arranged at the interface between said first surface and said second surface. This variant presents notably the advantage that it is simple to implement. The first surface has a role of conducting line toward the breakers which are placed near the edges of the antenna so as to produce an efficient excitation of the antenna. The second surface comprises the peripheral zones of the second antenna, suitable for producing an efficient radiation or for efficiently picking up incident signals.

According to a variant of the invention, the first conducting surface of the second radiating element is linked to the first radiating element (201) by a through connection. Such a mode of connection is simple to implement and gives rise to a very low attenuation of the signals in terms of power.

According to a variant of the invention, the conducting surfaces are isolated by a slot formed around a junction point between said first surface and said through connection.

According to a variant of the invention, the switching means are arranged one in relation to the other in a substantially symmetric manner with respect to the center of the second radiating element. This arrangement of the switching means allows the currents to be made to flow in phase opposition, depending on whether the current passes through the first switching means or the second switching means.

According to a variant of the invention, the junction point between said first surface and said through connection is situated substantially at the center of the second radiating element.

It should be noted that when the radiating element is not square, the first surface is preferably circumscribed to a small zone situated in the middle zone of the patch so as to avoid the appearance of stray currents.

According to a variant of the invention, the junction point between said first surface and said through connection is situated outside of a middle zone of the second radiating element.

According to a variant of the invention, said first and second surfaces form a planar antenna, said first surface being a lower surface arranged close to the ground plane and being linked to the first radiating element, said second surface being an upper surface arranged opposite from the lower surface and the first switching means being arranged between the lower surface and the first radiating element, the second switching means being arranged between the upper surface and the first radiating element, each of the two switching means forming a through connection and at least one junction point between each lower or upper surface and the first radiating element being envisaged for this through connection.

According to a variant of the invention, the first radiating element forms a planar antenna whose junction point between the first radiating element and said through connection is situated substantially at the center of the first radiating element which comprises an isolating zone at least partially surrounding said junction point, so as to form a conducting line linking said junction point to a peripheral zone of the first conducting element. This embodiment presents notably the advantage of being compact, it being possible for the two antennas to be placed facing one another. Thus, with this configuration, it is possible to arrange a larger number of cells in a transmitter array.

According to a variant of the invention, the first radiating element forms a planar antenna whose junction point between the first radiating element and said through connection is situated away from the middle of this first radiating element.

According to a variant of the invention, the angular position of the first radiating element about an axis orthogonal to the plane of this element and passing through said junction point is chosen as a function of the desired polarization of the signal transmitted by the cell. This embodiment makes it possible to act on the position of the first antenna, the rotation of the latter around the junction point making it possible to choose the polarization of the signal to be transmitted.

According to a variant of the invention, the ground plane is connected to the first radiating element, the cell comprising a control conducting line linked to the second surface of the second element, said control conducting line being able to transport an electric current to polarize said switching means. Such means are very simple for controlling the breakers.

According to a variant of the invention, the ground plane is connected to the second surface of the second radiating element, the cell comprising a control conducting line linked to the first radiating element, said control conducting line being able to transport an electric current to polarize said switching means.

According to a variant of the invention, the ground plane and the control line are connected to the radiating elements via connections passing through at least one dielectric layer.

According to a variant of the invention, the first switching means are a diode whose anode is connected to the second surface and whose cathode is connected to the first surface, the second switching means being a diode whose anode is connected to the second surface and whose cathode being connected to the first surface.

The subject of the invention is also an array comprising at least two radiating cells according to the invention, each of said two cells being controlled so as to modify the phase state of the signal transmitted by this cell, so as to configure the radiation pattern of said array.

BRIEF DESCRIPTION OF THE DRAWINGS

Other characteristics will become apparent on reading the detailed and nonlimiting description which follows, given by way of example in relation with appended drawings which represent.

In these figures, the same references are used to designate the same elements.

DETAILED DESCRIPTION

In the subsequent description, the characteristics and functions well known to the person skilled in the art are not described in detail.

Moreover, the figures are not to scale, and they are oriented with respect to an XYZ axis comprising two horizontal orthogonal directions X and Y and a vertical direction Z perpendicular to the other two directions.

The terms "up"/"down", "above"/"below", "lower"/"upper" are defined with respect to the Z direction.

The radiating cell of the invention is able to transmit/receive electromagnetic waves (in the Z direction) at a working frequency ft (or nominal frequency) corresponding to a wavelength λt, typically this frequency lies between 100 MHz and 100 GHz, preferably between 1 GHz and 10 GHz.

Generally, the cell according to the invention can generate two transmission phase states separated by 180°, the phase being controlled by an electrical control signal. This cell therefore makes it possible to implement a transmitter array comprising a large number of cells and whose phase law can be driven electrically by a set of control signals with a phase quantization of ±90°.

This driving of the phase shift of the radiating cell of the invention is obtained by virtue of the use of simple switching means which are alternatively in the on or off state.

These switching means can be radiofrequency breakers such as diodes, MEMS, phototransistors or any other component having a similar functionality with two states on/off. These components are generally reciprocal; so, the cell can therefore operate in an identical manner in reception or transmission.

By virtue of the use of these breakers, the cell of the invention exhibits low losses which what is more are identical losses in the two phase states.

To widen the passband of the cell, the cell can comprise, above the first radiating element and/or the second radiating element, a stack comprising a substrate alternation of metallic layers.

Figure 1:
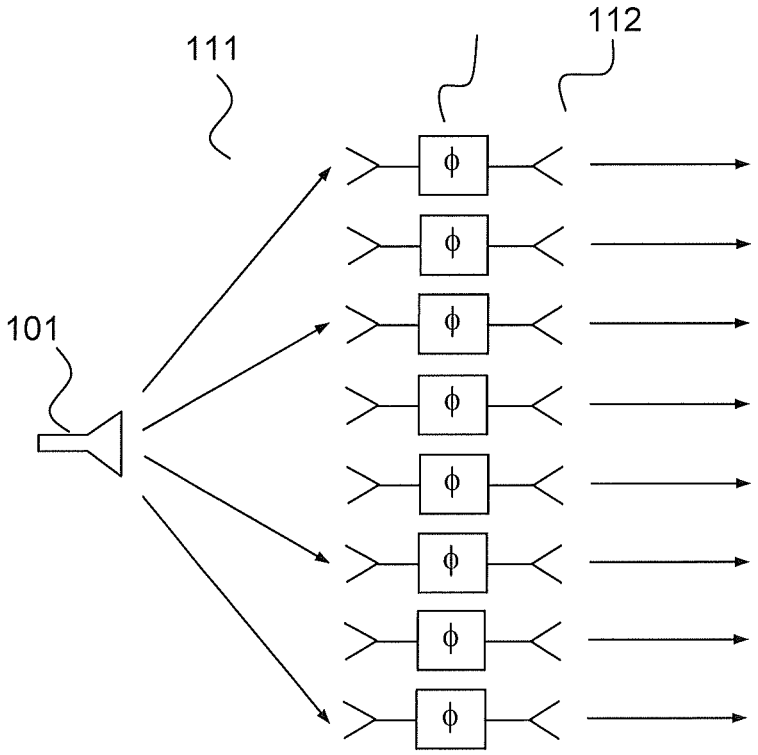
FIG.1 Prior Art
FIG. 1, a diagram illustrating the operating principle of a transmitter array antenna; this figure has already been presented above.
Figures 2A, 2B, 2C:
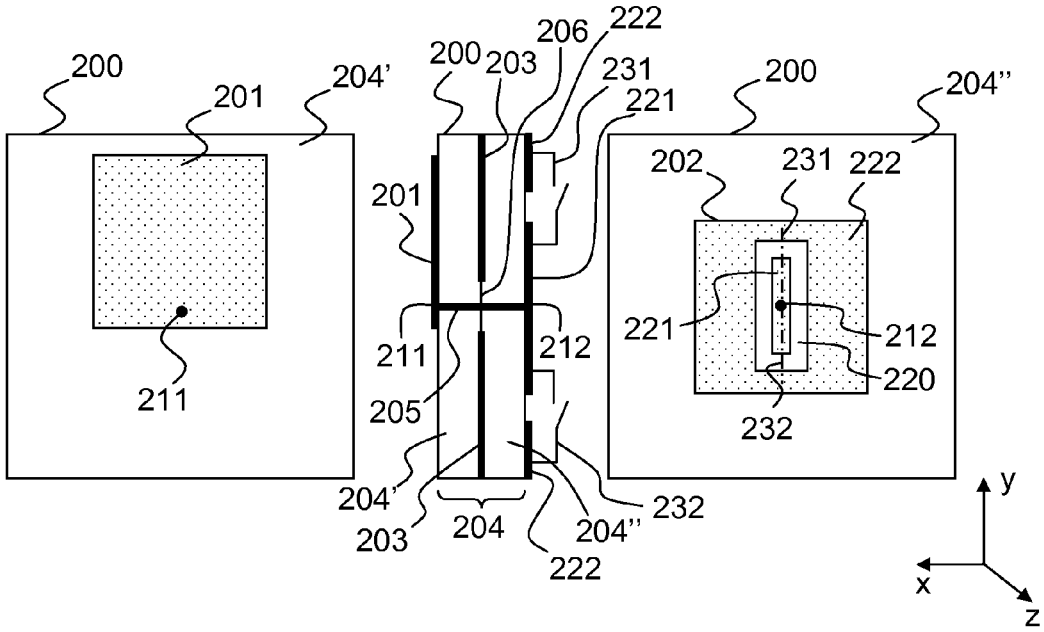
FIGS. 2*a*, 2*b*, 2*c* and 2*d*, diagrams representing a first embodiment of the cell according to the invention.
Figure 2D:
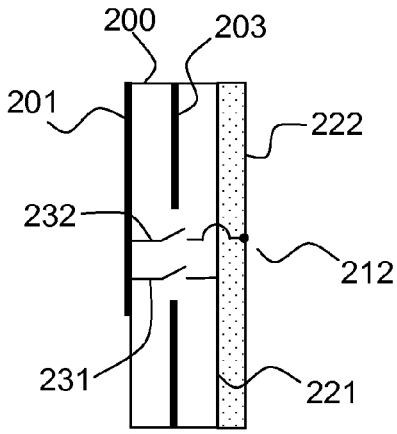

FIGS. 2*a*, 2*b*, 2*c* and 2*d* present a first embodiment of a cell according to the invention. FIG. 2*a* is a view from below of the cell 200, FIGS. 2*b* and 2*d* are a cross-sectional view of the cell 200 and of its variant respectively, and FIG. 2*c* is a view from above of the cell 200.

In this example, the cell 200 comprises two elementary antennas arranged on either side of a ground plane 203.

More particularly, if it is considered that an elementary antenna comprises a radiating element separated by the ground plane from at least one dielectric layer, the cell 200 therefore comprises a first radiating element 201 and a second radiating element 202 arranged on either side of the ground plane 203 hugged in an assemblage 204 of at least two substrates (or substrate-forming dielectric layers) 204', 204".

Each elementary antenna can be embodied by a planar or patch antenna which is a plane antenna whose radiating element is a generally square conducting surface, separated from a conducting reflecting plane (or ground plane) by a dielectric layer. The implementation of a planar antenna such as this resembles a double-sided printed circuit, substrate, and is therefore favorable to industrial production, notably for easy integration into an array of antennas.

The two radiating elements 201, 202 are linked by a through connection 205 traversing the substrate 204 and passing through an aperture 206 formed in the ground plane 203. The connection 205 has no contact with the ground plane 203 which forms an electromagnetic shielding between the two radiating elements 201, 202.

The connection 205 and the first radiating element 201 are linked at the level of a connection point 211. This connection point 211 is preferably situated near an edge of this element 201 so as to improve the radiation of this element.

The connection 205 and the second radiating element 202 are linked at the level of a connection point 212 preferably situated at the center or close to the center of this element 202, and preferably, at a distance from the center not exceeding a quarter of the width of the radiating element 202, so as to favor the principal mode of resonance of the radiating element along its length and not excite other undesired modes.

A slot 220 is formed in the second radiating element 202 around the connection point 212, so as to create two disjoint surfaces 221, 222 in this radiating element 202.

A first conducting surface portion, termed the "internal surface" 221 is situated in contact with the connection point 212, and is separated from a second conducting surface portion, termed the "external surface" 222 which surrounds the internal surface 221 without coming into contact with it.

The slot 220 thus makes it possible to electrically isolate the internal surface 221 from the external surface 222. In the example, the second radiating element 202 has a symmetric geometry, thereby making it possible to minimize the excitation of undesired modes of resonance which would degrade the polarization of the electromagnetic field radiated by the antenna.

The first conducting surface 221 forms a narrow substantially rectangular conduction band extending between two opposite peripheral zones of the second radiating element 202, the switching means 231, 232 being arranged at the interface between each of said peripheral zones and said conduction band.

The term "narrow" is understood to mean a sufficiently small width to avoid the appearance of stray radiations, but sufficiently large to convey a current between the aforementioned junction point and each of the switching means.

According to the invention, two breakers 231, 232 are placed at the junction between the internal surface 221 and the external surface 222 to establish current passages through the slot of the second radiating element 202.

An incident current arriving via the connection point 212 can thus flow via the internal surface 221, pass through that one of the breakers 231 or 232 which is closed and then flow in the external surface 222. Reciprocally a current caused by the reception of a wave on the external surface 222 of the second radiating element 202 will be able to flow toward the connection point 212 only across one of the two closed breakers 231, 232 and thereafter be conducted toward the first radiating element 201, via the through connection 205.

The breakers 231, 232 are arranged in a symmetric and diametrically opposite manner with respect to the connection point 212, so that a current issuing from the first breaker 231 excites the external surface 222 of the second radiating element 202 with a phase state opposite to that corresponding to a current issuing from the second breaker 232.

It should be noted that at least one transmission line (not represented in the figures) can be arranged close to one of the two radiating elements in order to supply the power feed to this element which in its turn transmits it to the other radiating element by virtue of the through connection 205.

In the present example, the excitation point is either the point of the breaker 231 or the point of the breaker 232, given that the two elements are linked together, thereby causing the excitation of a single propagation mode.

The breakers 231, 232 are controlled in alternation, so that when the first breaker 231 is open, the second breaker 232 is closed, and that when the first breaker 231 is closed, the second breaker 232 is open. This mode of control makes it possible to place the cell 200 in two different states:

- a first state in which a signal issuing from the first radiating element 201 is conducted toward the external surface 222 of the second radiating element 202 via the first breaker 231 so as to cause a radiation with a phase $\phi_1$;
- a second state in which a signal issuing from the first radiating element 201 is conducted toward the external surface 222 of the second radiating element 202 via the second breaker 232 so as to cause a radiation with a phase $\phi_2$ equal to $\phi_1+180°$.

The operation of the cell 200 in reception mode on the first radiating element 201 and transmission mode on the second radiating element 202 is described, but the cell 200 can operate reciprocally so as to transmit a signal received on the second radiating element 202 to the first radiating element 201, notably when the cell 200 does not comprise any non-reciprocal elements such as an amplifier, a mixer or indeed a non-integrated phase shifter.

The example presented in FIG. 2 can be modified to give rise to several variant embodiments. In the example, the radiating elements can be patch antennas 201, 202 of square shape, but a rectangular, circular, elliptical, triangular shape, for example, could be employed. An antenna in the form of a dipole or spiral shape could also be used.

According to a variant of the first embodiment of the invention, illustrated in FIG. 2*d*, the two conducting surfaces 221, 222 are, respectively, the lower and upper surface of the radiating element and are disjoint and separated from one another by a dielectric layer so as to electrically isolate them. The lower surface 221 is close to the ground plane and the upper surface 222 is opposite from the lower surface 221.

In this variant, the first breaker 231 is linked to the lower surface 221 on the one hand and to the first radiating element 201 on the other hand, and the second breaker 232 is linked to the upper surface 222 on the one hand and to the first radiating element 201 on the other hand, the breaker which is closed acting as connection between the two radiating elements.

An aperture provided in the ground plane 205 allows the passage of these two breakers inside the structure of the radiating cell 200.

The power feed for these two surfaces is supplied by at least one transmission line so as to generate an off or on state for each breaker alternately.

Moreover, the relative angular position of the two radiating elements 201, 202 can be modified. Stated otherwise, the radiating elements can be aligned, as in FIG. 2*b*, or their relative angular position can be modified.

Indeed, for example, the first radiating element 201 can be rotated about the rotation axis formed by the connection 205, in such a way as to change the polarization of the transmitted signal. Thus, the first radiating element 201 can be rotated 90°, in such a way that a signal received with vertical polarization is transmitted with horizontal polarization by the second radiating element 202.

Moreover, to widen the passband, additional radiating elements 201, 202 can be positioned above/below the aforementioned two patches 201, 202, according to the principle of coupled superposed patches, known to the person skilled in the art, a principle also designated by the expression "stacked patch antennas".

Moreover, the slot 220 can be annular, circular, elliptical or have yet another shape; this slot 220 makes it possible to create two separated conducting surfaces 221, 222, the first conducting surface 221 being linked to the first radiating element 201, and the second conducting surface 222 being able to radiate, this second conducting surface 222 comprising the peripheral conducting zones of the second radiating element 202, that is to say the zones close to the edges of this element 202 which are propitious to good radiation, the second surface 222 being larger than the first surface 221 so as to surround it.

Instead of a slot, an insulating material could be employed to isolate the two conducting surfaces 221, 222.

Moreover, the presence of two conducting surfaces 221, 222 separated at the surface of the second radiating element 202 is not necessary. For example, the through connection 205 splits in two branches, each of these branches being connected to the first port of a breaker, the breakers being placed in opposite senses, the second ports of the breakers being connected to diametrically opposite locations of the conducting surface 222 of the second radiating element 202.

According to yet another variant of the first embodiment, less compact than that of FIGS. 2*a*, 2*b*, 2*c*, a conducting passage exterior to the conducting surface of the second radiating element 202 links the first radiating element 201 to each of the breakers 231, 232. For example, a conducting line starting from the first antenna 201 emerges onto a port of a breaker situated near an edge of the second radiating element 202.

In all cases, the breakers operate in opposition and are disposed in such a way as to excite the second radiating element 202 by currents in phase opposition.

Multiple technologies of radiofrequency breakers can be employed in the cell according to the invention, for example diodes, transistors, photodiodes, phototransistors, MEMS (Micro Electro Mechanical Systems), NEMS (Nano Electro Mechanical Systems).

Furthermore, the breakers 231, 232 can be embodied with the aid of two independent components or else with a single component comprising two breakers and comprising a function of 1-to-2 breakers, a function sometimes designated by the initials SPDT standing for "Single Pole Double Throw", that is to say a function provided with one input and two switched outputs.

Figure 4A:
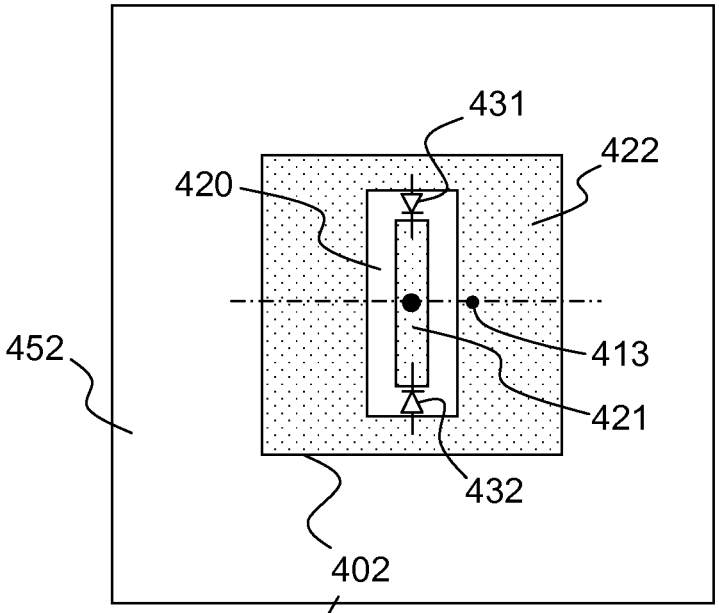
FIGS. 4*a*, 4*b* and 4*c*, diagrams representing an exemplary cell according to the invention with control means making it possible to choose the phase shift applied to the signal.
Figure 4B:
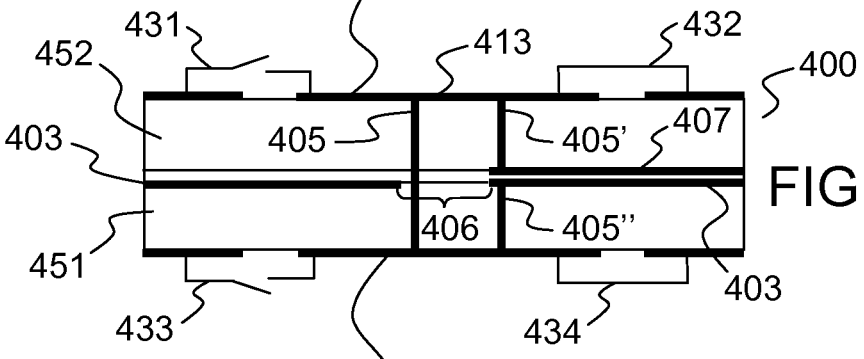
Figure 4C:
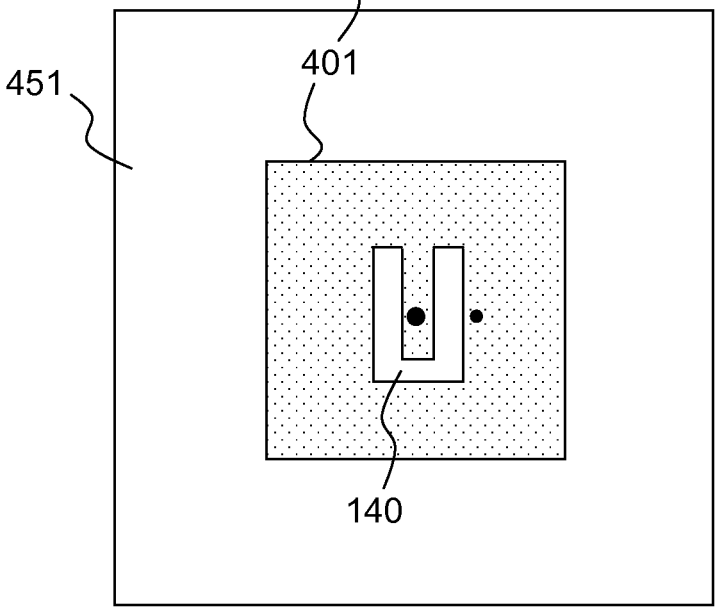

The type of device to be employed to control the breakers depends notably on the breaker technology chosen. The following devices may for example be used:

- conducting control lines directly connected to the second patch antenna 202 or to the breakers 231, 232, as illustrated further on in FIGS. 4*a*, 4*b*, 4*c;*
- an optical fiber if a breaker of photo-electric type is used;
- a laser beam generated by exterior means and exciting a breaker of photo-electric type;
- an electromagnetic wave according to principles of tele-power feed, known from the field of RFID (Radio Frequency Identification).

Figures 3A, 3B, 3C:
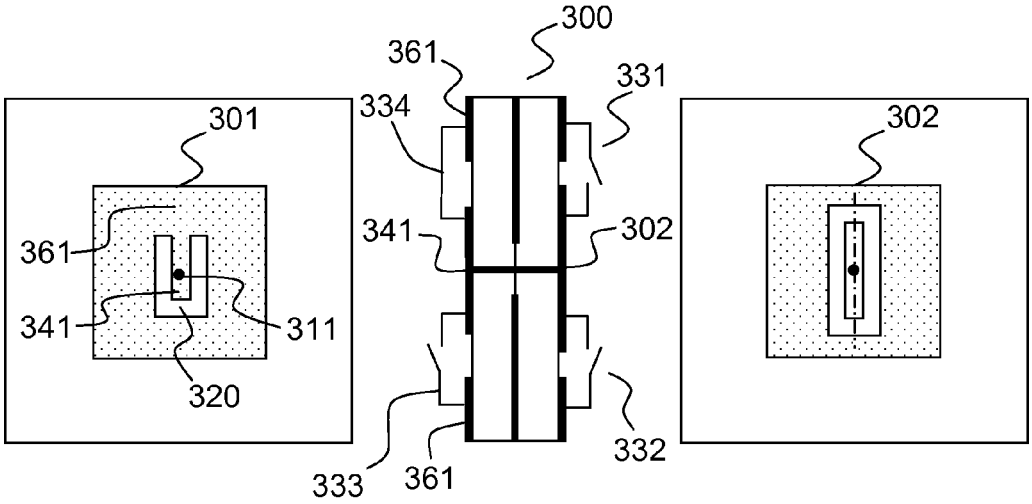
FIGS. 3*a*, 3*b* and 3*c*, diagrams representing a second embodiment of the cell according to the invention.

A second embodiment is illustrated in FIGS. 3*a*, 3*b* and 3*c*.

FIG. 3*a* is a view from below of the cell 300, FIG. 3*b* is a cross-sectional view of the cell 300, and FIG. 3*c* is a view from above of the cell 300.

In the example of FIGS. 3*a*, 3*b* and 3*c*, the connection point 311 of the first radiating element 301 is situated at the center of the surface of this element 301, so as to minimize the bulk of the cell, since the two radiating elements 301, 302 lie face to face.

In order to ensure satisfactory operation of the first radiating element 301, a U-shaped slot 320 is formed around the connection point 311, in such a way that the connection point 311 is situated on a conducting band 341 formed inside the U, this conducting band 341 culminating at the level of the periphery 361 of the first radiating element 301. The conducting band 341 therefore acts as a conduction line making it possible to efficiently excite the first radiating element 301 at the level of its periphery.

The term "periphery" or "peripheral zone" is understood as meaning a zone situated at a distance of less than a third of the width of the radiating element, preferably less than a quarter of its width, from the edge of this element.

Four breakers 331, 332, 333 and 334 are envisaged, the breaker 334 being in the closed position.

FIGS. 4*a*, 4*b* and 4*c* present an exemplary embodiment of the cell according to the invention operating around a central frequency of 9.5 GHz, the cell comprising control means making it possible to choose the phase shift applied to the transmitted signal.

FIG. 4*a* is a view from below of the cell 400, FIG. 4*b* is a cross-sectional view of the cell 400, and FIG. 4*c* is a view from above of the cell 400.

The cell 400 comprises a ground plane 403 flanked by two substrates 451, 452 of Rogers RO4003 type, whose relative permittivity is equal to 3.38 and whose thickness is equal to 1.524 mm.

The cell 400 also comprises a bonding film 40 mm thick. This film is visible in FIG. 4*b* between the ground plane 403 and the line 407. Its role is the bonding of the substrates and electrical insulation between the line 407 and the ground plane 403.

The first substrate 451 comprises on its lower face a first rectangular radiating element 401, of dimensions 8.2×7.4 mm, and provided with a U-shaped slot 140, the ground plane 403 being arranged on the upper face of the first substrate 451.

The second substrate 452 comprises a second rectangular radiating element 402 of the same dimensions as the first element 401, but provided with an annular slot 420 on its upper face.

The two radiating elements 401, 402 are linked by a vertical connection 405 placed at the center of the cell 400 and passing through an aperture 406 made in the ground plane 403.

The second radiating element 402 comprises, in the example, two diodes 431, 432 of MACOM MA4AGP907 type placed at two opposite ends of the annular slot 420.

The anode of the first diode 431 is connected to the conducting surface 422 girding the annular slot 420, while the cathode of this same diode 431 is connected to the conducting surface included inside the annular slot 420. In the opposite manner, the anode of the second diode 432 is connected to the conducting surface 421 included inside the annular slot 420, while the cathode of the second diode 432 is connected to the conducting surface 422 girding the annular slot 420.

The biasing of the diodes 431, 432 is performed by a conducting line 407 placed on the lower face of the second substrate 452 and linked to the second radiating element 402 by a second through connection 405'. This through connection 405' is placed on the mid-line, represented dashed in FIG. 4*a*, of this second element 402, so that the connection point 413 forming the junction between the through connection 405' and this second element 402 corresponds to a point of zero voltage between this second element 402 and the ground plane 403; this position minimizing the perturbation of the second radiating element 402 by this through connection 405'.

Similarly, another connection 405" connects the first radiating element 401 and the ground plane 403.

The diodes 431, 432 are controlled by a positive or negative current between the conducting line 407 and the ground plane 403. The diodes 433, 434 are then reverse-biased, so as to place them in opposite states, on/off or off/on.

According to another embodiment, the conducting line 407 is hooked up to the first radiating element 401 and the ground plane 403 is hooked up to the radiating surface 422 of the second radiating element 402; in this case, the bias of the breakers follows the same principle but is reversed.

Figure 5:
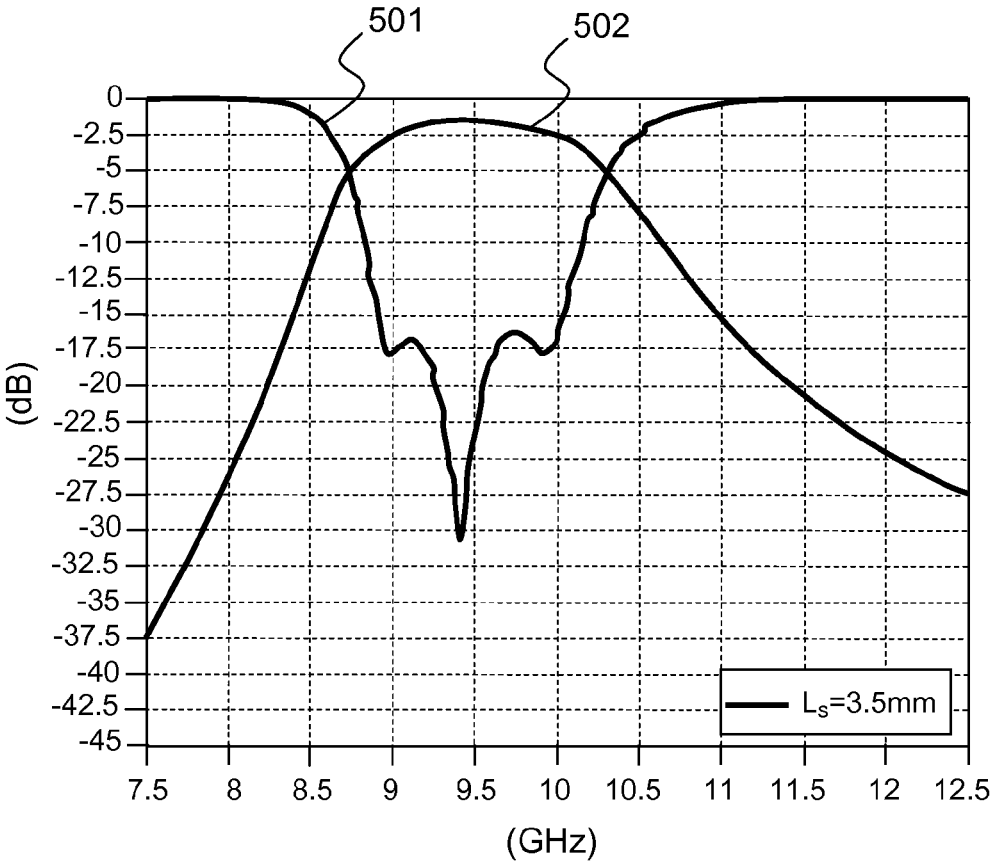
FIG. 5, curves presenting the evolution of the reflection and transmission coefficients of the cell of FIGS. 4*a*, 4*b* and 4*c* as a function of the frequency of the transmitted signal.

FIG. 5 illustrates, by curves, the evolution of the reflection coefficient S11 and transmission coefficient S21 of the cell 400 of FIGS. 4*a*, 4*b* and 4*c* as a function of the frequency of the signal transmitted by this cell.

The transmission losses are identical in the two bias states of the diodes (that is to say if the first breaker is off and the second breaker is on, or if the first breaker is on and the second breaker is off); these losses are equal to 1.8 dB at the frequency of 9.5 GHz, this being much better than the performance obtained with the implementations of the prior art. The passband at −3 dB is 1.75 GHz, i.e. about 17%.

Figure 6:
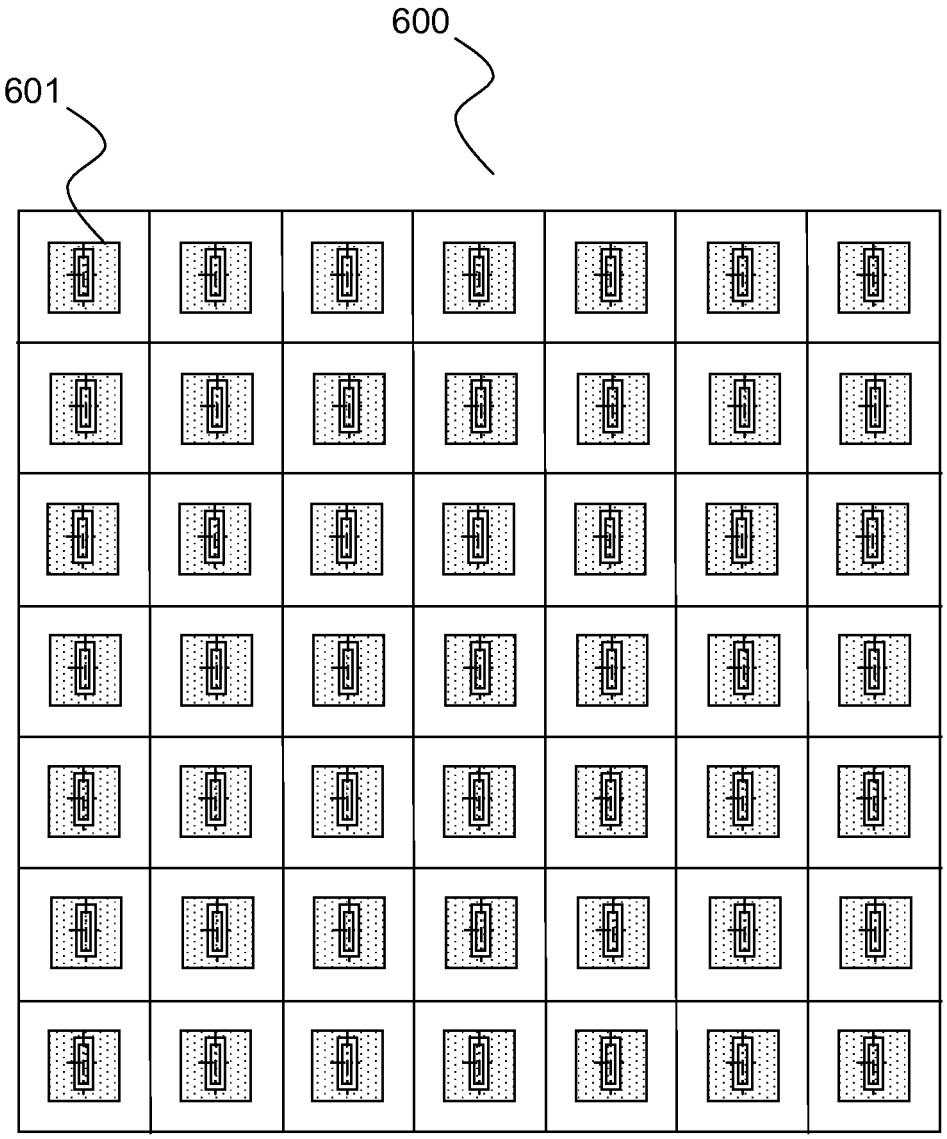
FIG. 6, a diagram representing an exemplary transmitter array comprising reconfigurable cells according to the invention.

FIG. 6 presents an exemplary transmitter array comprising reconfigurable cells according to the invention.

The array 600 of this example comprises a square of 7×7 identical cells 601, each of them being able to be controlled independently, so as to control the radiation pattern of the array.

Such a transmitter array can be used in military radar systems at microwave frequencies. It can also be employed in applications such as long distance terrestrial or satellite communications systems, short- or medium-range wireless links (for example a wireless local network or a wireless metropolitan network), or else radar or imaging devices at millimeter or submillimeter frequencies.

An advantage of the cell according to the invention is its simplicity of implementation. Indeed, the breakers are not necessarily fitted inside the cell but may also be fitted, depending on the embodiments, on the outside and on a single face.

In addition, to further facilitate the implementation of the cell, it is possible to group the two breakers into a single component to be fixed by virtue of a conventional transfer method.

The cell according to the invention benefits from low losses, notably on account of the use of only two breakers. Moreover, the losses are identical in the two phase states, since these two states are caused by symmetric configurations.

Besides, the cell according to the invention can benefit from passband widening techniques. For example, the radiating elements or patches can be designed to operate over a wide passband, by using a substrate of low permittivity and patches coupled above each of the patch antennas of the cell.

Moreover, it should be noted that the cell according to the invention operates according to a principle of switching between several feed points of the antenna, as opposed to the principle of perturbation or of switching of resonators which are intrinsically small band.

Finally, the dimensions of the cell are reduced, notably by virtue of the mode of connection between the two radiating elements, which makes it possible to have a cell whose lateral dimensions are less than half a wavelength. It is additionally desirable to have cells of small dimensions (that is to say less than or equal to half a wavelength) so as to optimize their efficiency.

Other variants can also be envisaged without departing from the scope of the invention. It is for example possible for the structure to be entirely symmetric in the sense that the two radiating elements may be identical and both provided with a rectangular or annular slot in the middle separating the conducting surfaces.

It is also possible to have a breaker on the first radiating element and another breaker on the second radiating element so that the two breakers are controlled in a reversed manner so as to create the two desired phase states.

The invention claimed is:

1. A radiating cell for forming an antenna integratable into an array and able to transmit microwave frequency signals, comprising a first radiating element and a second radiating element linked by a through connection and arranged on either side of a ground plane, the second radiating element comprising at least one conducting surface able to radiate, the second radiating element comprising first and second disjoint surfaces electrically isolated from one another, further comprising: at least a first and a second switching means, said means each comprising an on state and an off state between two ports, one of said ports being connected to the second radiating element, said switching means being controlled in opposition so that when said first switching means is in the on state, said second means is in the off state, the first and second switching means furthermore being controlled so that the current flowing in said conducting surface is in phase opposition depending on whether the first switching means is in the on state or whether the second switching means is in the on state.

2. The radiating cell as claimed in claim 1, in which said first and second surfaces form a planar antenna, said first surface being linked to the first radiating element, said second surface comprising peripheral conducting zones of the second radiating element, the switching means being arranged at the interface between said first surface and said second surface.

3. The radiating cell as claimed in claim 2, in which the first conducting surface of the second radiating element is linked to the first radiating element by the through connection.

4. The radiating cell as claimed in claim 3, in which several conducting surfaces are isolated by a slot formed around a junction point between said first surface and said through connection.

5. The radiating cell as claimed in claim 4, in which the switching means are arranged one relatively with respect to the other in a symmetric manner with respect to the center of the second radiating element.

6. The radiating cell as claimed in claim 4, wherein the junction point between said first surface and said through connection is situated at the center of the second radiating element.

7. The radiating cell as claimed in claim 4, wherein the junction point between said first surface and said through connection is situated outside of a middle zone of the second radiating element.

8. The radiating cell as claimed in claim 3, in which the first radiating element forms a planar antenna whose junction point between the first radiating element and said through connection is situated at the center of the first radiating element which comprises an isolating zone at least partially surrounding said junction point, so as to form a conducting line linking said junction point to a peripheral zone of the first conducting element.

9. The radiating cell as claimed in claim 3, in which the first radiating element forms a planar antenna whose junction point between the first radiating element and said through connection is situated away from the middle of this first radiating element.

10. The radiating cell as claimed in claim 1, in which said first and second surfaces form a planar antenna, said first surface being a lower surface arranged close to the ground plane and being linked to the first radiating element, said second surface being an upper surface arranged opposite from the lower surface, the first switching means being arranged between the lower surface and the first radiating element and the second switching means is arranged between the upper surface and the first radiating element, and each of the two switching means forming a through connection and at least one junction point between each lower or upper surface and the first radiating element being envisaged for this through connection.

11. The radiating cell as claimed in claim 1, in which the angular position of the first radiating element about an axis orthogonal to the plane of this element and passing through said junction point is chosen as a function of the desired polarization of the signal transmitted by the cell.

12. The radiating cell as claimed in claim 1, in which the ground plane is connected to the first radiating element, the cell comprising a control conducting line linked to the second surface of the second element, said control conducting line being able to transport an electric current to polarize said switching means.

13. The radiating cell as claimed in claim 12, in which the ground plane and the control line are connected to the radiating elements via connections passing through at least one dielectric layer.

14. The radiating cell as claimed in claim 1, in which the ground plane is connected to the second surface of the second radiating element, the cell comprising a control conducting line linked to the first radiating element, said control conducting line being able to transport an electric current to polarize said switching means.

15. The radiating cell as claimed in claim 1, in which the first switching means are a diode whose anode is connected to the second surface and whose cathode is connected to the first surface, the second switching means being a diode whose anode is connected to the second surface and whose cathode being connected to the first surface.

16. A transmitter array comprising at least two radiating cells as claimed in claim 1, each of said two cells being controlled so as to modify the phase state of the signal transmitted by this cell, so as to configure the radiation pattern of said array.

* * * * *

UNITED STATES PATENT AND TRADEMARK OFFICE

CERTIFICATE OF CORRECTION

PATENT NO. : 9,099,775 B2
APPLICATION NO. : 13/995877
DATED : August 4, 2015
INVENTOR(S) : Laurent Dussopt et al.

It is certified that error appears in the above-identified patent and that said Letters Patent is hereby corrected as shown below:

ON THE TITLE PAGE ITEM 73 SHOULD READ

In the Assignee Information:

The Assignee "Commissariat A L'Energies Alternatives," should be --Commissariat A L'Energie Atomique et aux Energies Alternatives--.

Signed and Sealed this
Eighth Day of March, 2016

Michelle K. Lee

Michelle K. Lee
*Director of the United States Patent and Trademark Office*